United States Patent [19]

Berges et al.

[11] Patent Number: 5,035,585

[45] Date of Patent: Jul. 30, 1991

[54] MULTIPLE CONNECTOR FOR ROTATION VACUUM PUMPS

[75] Inventors: Hanns-Peter Berges, Koeln; Wolfgang Leier, Bergisch-Gladbach, both of Fed. Rep. of Germany

[73] Assignee: Leybold Aktiengesellschaft, Fed. Rep. of Germany

[21] Appl. No.: 379,868

[22] Filed: Jul. 14, 1989

[30] Foreign Application Priority Data

Jul. 14, 1988 [EP] European Pat. Off. ..... 88111277.5

[51] Int. Cl.[5] ..... F04B 35/00

[52] U.S. Cl. ..... 417/362; 417/423.5; 417/423.6; 417/423.14

[58] Field of Search ..... 417/271, 362, 423.2, 417/423.5, 423.6, 423.12, 423.14, 423.15, 426–428, 199.1–206, 521; 74/665 GA, 421 R, 421 A; 418/5, 9–13, 199, 209

[56] References Cited

U.S. PATENT DOCUMENTS

| | | | |
|---|---|---|---|
| 912,198 | 2/1909 | Stafford | 74/665 GA X |
| 1,818,643 | 8/1931 | Nieman | 74/665 GA |
| 2,185,338 | 1/1940 | Hassler | 418/199 X |
| 2,902,886 | 9/1959 | Nacker | 74/665 GA |
| 2,905,011 | 9/1959 | Armstrong et al. | 74/665 GA X |
| 3,299,685 | 1/1967 | Kocks et al. | 74/665 GA X |
| 3,612,729 | 10/1971 | Commarmot | 417/521 X |
| 4,068,984 | 1/1978 | Spindler | 418/199 X |
| 4,408,891 | 10/1983 | Schirk et al. | 366/265 |

FOREIGN PATENT DOCUMENTS

| | | | |
|---|---|---|---|
| 0830160 | 12/1951 | Fed. Rep. of Germany | 417/423.5 |
| 3706588 | 8/1988 | Fed. Rep. of Germany | 417/362 |
| 63-272987 | 11/1988 | Japan | 417/362 |
| 714765 | 9/1954 | United Kingdom . | |
| 1510962 | 5/1978 | United Kingdom . | |
| 2207190 | 1/1989 | United Kingdom | 417/362 |

*Primary Examiner*—Leonard E. Smith
*Assistant Examiner*—Eugene L. Szczecina, Jr.
*Attorney, Agent, or Firm*—Hill, Van Santen, Steadman & Simpson

[57] ABSTRACT

The invention refers to a multiple connection of rotation vacuum pumps having a common housing and drive motor. The vacuum pumps arranged in two rows. Each one of the vacuum pumps has a pump gear, and these gears, together with a drive gear, are arranged such that they form a single row with their teeth drivingly intermeshed. Preferably only inner parts of the pump are located in the housing.

5 Claims, 3 Drawing Sheets

5
15
25
22
11
12
23
24
6
7
8
9
16
14
13
1
19
18
4
3
21

MULTIPLE CONNECTOR FOR ROTATION VACUUM PUMPS

TECHNICAL FIELD

This invention relates to a multiple connection for rotation vacuum pumps, with the pumps being arranged in two rows inside a common case and sharing a common drive motor.

BACKGROUND ART

It is known to accommodate several (4 to 12) vacuum pumps within a housing and to provide only one motor for their drive. For pump aggregations of this kind, the term "multiple connection" has gained acceptance. Usually, these multiple connections are used to connect rotary vane pumps. They are frequently applied in the filament lamp and tube industry.

In the case of a known multiple connection, the pumps are arranged in two rows. Each one of the pump shafts is equipped with a chain wheel. Each pump row is allocated a separate chain drive. A motor drives a shaft that goes through the case. This shaft is equipped with two chain wheels which are allocated to the pump chain drives. The space requirement of the two separate chain drives and of the drive shaft through the case is relatively high.

SUMMARY OF THE INVENTION

The present invention relates to a multiple connection in which each one of the vacuum pumps has a gear wheel, and that these gear wheels, together with a driving gear wheel, are arranged such that they form a row in which the teeth of the gears drivingly intermesh. With a multiple connection having these features, separate chain drives are no longer required. The drive gear and the gears of the individual pumps have direct contact in pairs. The number of elements transmitting the drive power from the motor to the individual shafts is significantly reduced.

It is therefore a primary object of the present invention to provide a multiple connection for rotation vacuum pumps that is compact and has reliable drive connections.

Another object of this invention is to provide a multiple connection having a common housing for its vacuum pumps, with dividing walls inside the housing forming a separate gear chamber for the drive connections.

Yet another object of this invention is to provide a multiple connection having bores in its dividing walls to conduct fluid to and from the vacuum pumps.

Still another object of this invention is to provide a multiple connection having pump gears floatingly secured to the shafts of the vacuum pumps.

In attainment of the foregoing objects, this invention contemplates a multiple connection where eaoh of the vacuum pumps has a toothed pump gear, and the drive motor is connected to a toothed drive gear. The pump gears and the drive gear are arranged in a single row, and their teeth are drivingly intermeshed. The drive gear is located approximately in the center of the row, and is attached to a shaft. The vacuum pumps and the shaft are alternatingly arranged on opposite sides of the row. In a preferred embodiment, the drive motor and the vacuum pumps are of a similar size, and the motor is alternatingly arranged along with the pumps. However, if the drive motor is too large, it can be arranged above the housing and connected to the pumps via a chain drive.

Other objects and advantages of the present invention will be apparent upon reference to the accompanying description when taken in conjunction with the following drawings.

DESCRIPTION OF THE PREFERRED EMBODIMENTS

Figure 1:
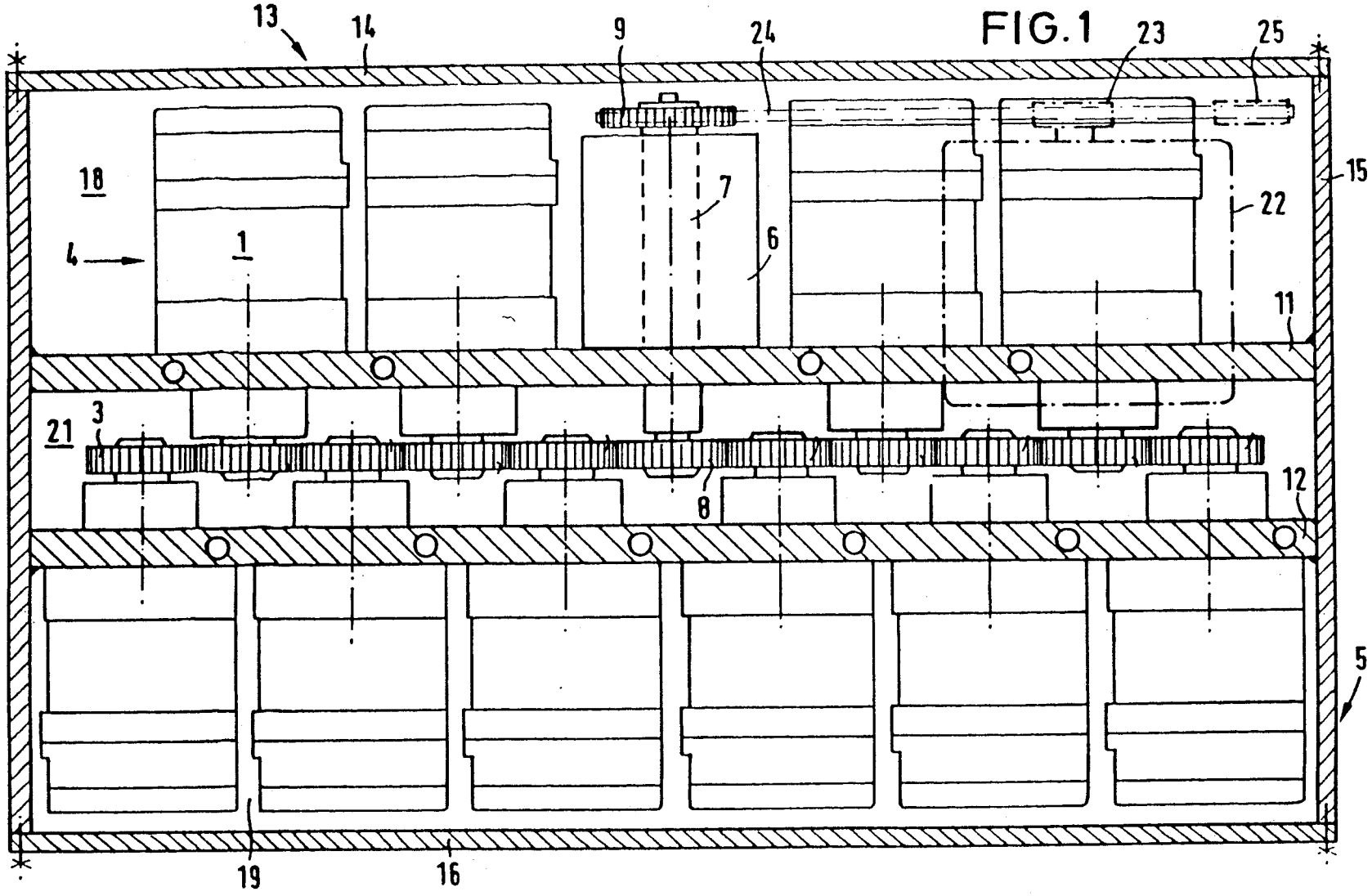
FIG. 1 is a plan view partially in section of a multiple connection according to the present invention.

In the ten-pump multiple connection shown in FIG. 1, the pumps are denoted with 1, and their toothed pump gears, which are arranged on the pump shafts 2 (FIG. 2) are denoted with 3. The pumps 1 form two rows 4 and 5, with four pumps in row 4 and six pumps in row 5. The center of row 4 has a support member 6 for a driving shaft 7, which, at its one end, is equipped with a toothed drive gear 8, and, at its other end, with a chain gear 9. Preferably, the pumps 1 only involve the inner parts of the pumps. The case 13 contains the oil required for the operation of the pumps.

Expediently, the drive gear 8 is located approximately in the center of the row of pump gears 3. This ensures a uniform distribution of the driving power, and thus a uniform load/strain of the drive gear 8. The vacuum pumps 1 and the shaft 7 of the drive gear 8 are advantageously arranged in alternating fashion on the two sides of the gear wheel row. The result thereof for the identically fashioned vacuum pumps is the respectively prescribed rotation direction of the drive.

A modern vacuum pump is composed of an inner part and a housing. The inner part comprises the anchor and the components constituting the pump chamber. The housing is surrounding the inner part and accepting the oil bin. According to a specific feature of the invention, only the inner parts of the pump are accommodated in the joint case 13 of the multiple connection, so that the case is constituting a housing common to the inner parts of the pump and containing the lubricating oil. Due to these measures, a further reduction of the space requirement is achieved. The application of additional features, like gas ballast, oil pump, filter and such is not impaired.

The pumps 1 and the support member 6 are fastened at two dividing walls 11, 12 of a housing 13, which includes the outer walls 14 to 17. The pump rows 4 and 5 are respectively located in the pump chambers 18 and 19, each of which is formed by one intermediate wall and outer walls of the case 13. The pump shafts 2 and the drive shaft 7 penetrate through the intermediate walls, so that the gears arranged on the shafts are located in the gear chamber 21 formed between the intermediate walls.

The size of the gears 3, 8 as well as the arrangement of the pumps 1 and of the support member 6 are selected such that the gears 3, 8 located in the chamber form a single row and that the teeth of the gears intermesh. In the middle of the row of gears, the drive gear 8 is located. In a preferred embodiment, the gears are of identical diameter (equal to half of the pump distance), and the pumps and support member are alternatingly on opposite sides of the row of gears.

Figure 3:
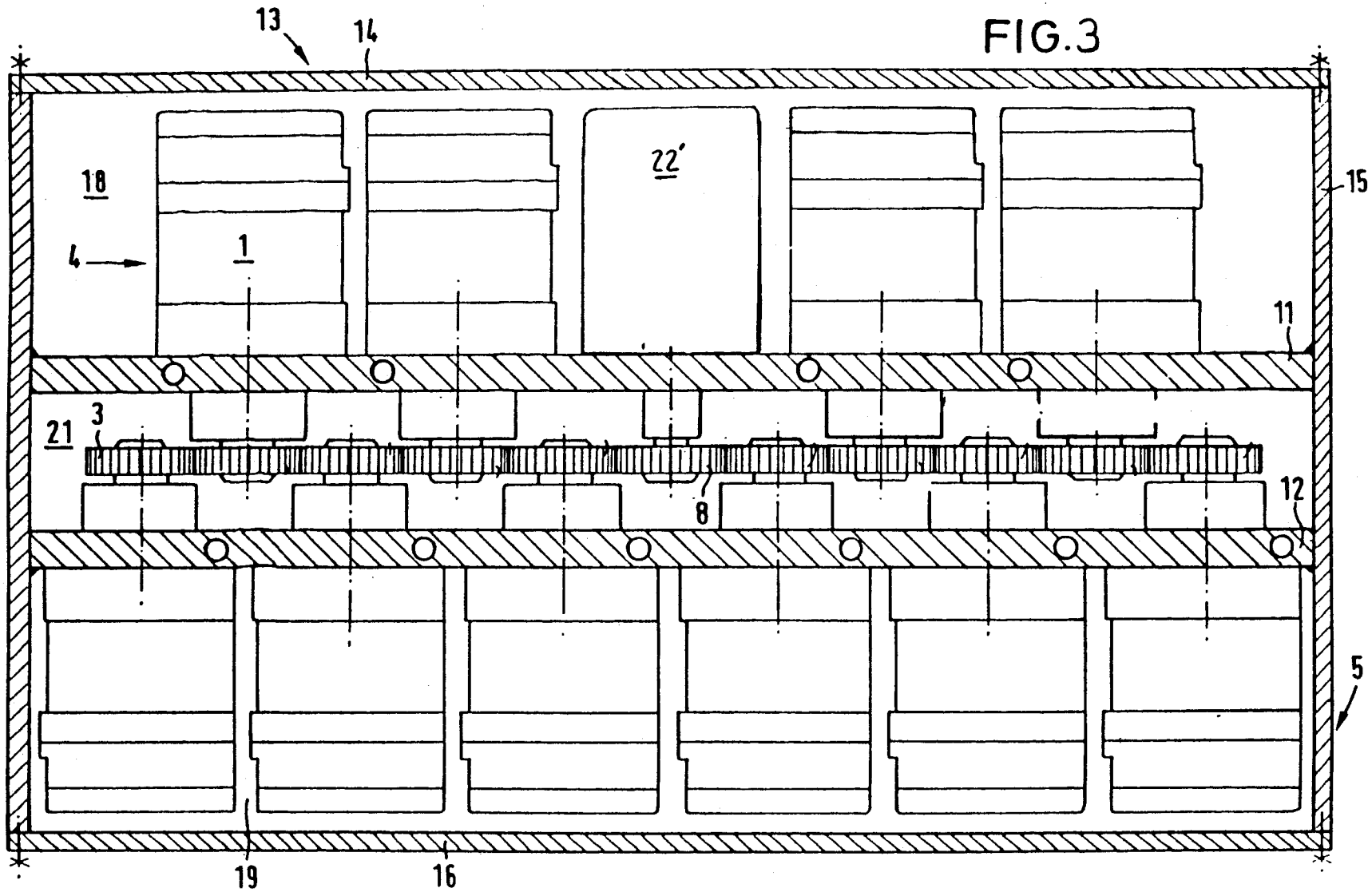
FIG. 3 is a plan view, partially in section, of a second embodiment of the present invention.

The drive motor 22 is located above the pumps 1. In FIG. 1 it is illustrated merely as a silhouette using a dash-dot line. The motor 22 includes a chain gear 23, which is connected with the chain gear 9 of the shaft 7 via the chain 24. A third chain gear 25 is provided having a clamping fixture that is not illustrated in detail. It lies at the height of the pumps 1 and leads the chain 24 below the pumps 1. This arrangement is required if the motor 22 is significantly larger than the pump member 1. With, for example, a multiple connection having fewer pumps, a smaller motor can be selected. If it is sufficiently small, as shown in FIG. 3, the drive motor 22' can be arranged directly in the row 4 of pumps instead of the support member 6.

Figure 2:
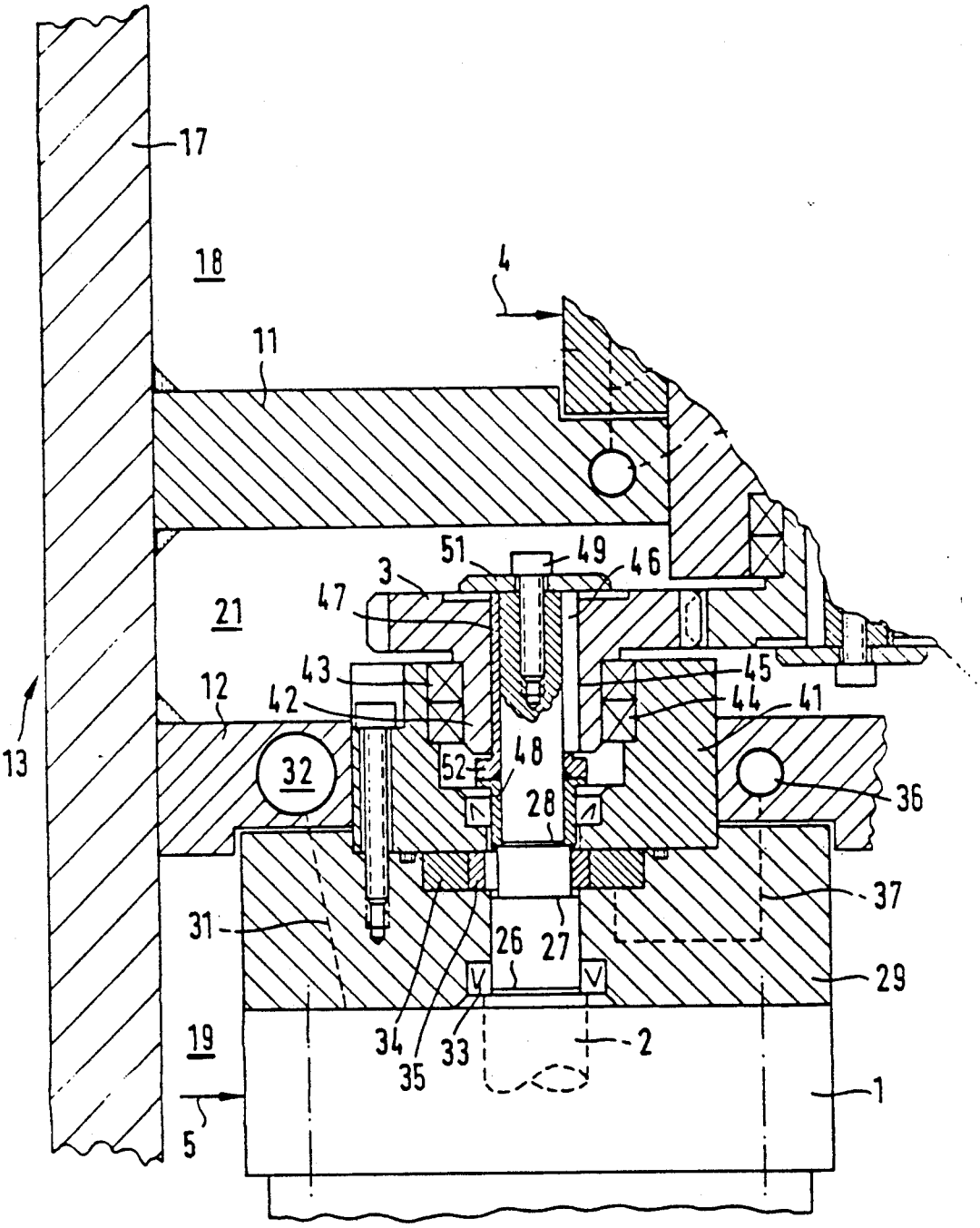
FIG. 2 is a cut-away sectional view the area of the gear wheels of one of the vacuum pumps forming part of the present invention.

The embodiment illustrated in FIG. 2 shows details of the fastening of the gear wheels 3 on the pump shaft 2. The end of the shaft 2 is provided with three steps 26, 27, and 28 and projects through the pump plate 29 and the respective intermediate wall into the gear chamber 21. The pump plate 29 laterally limits the pumping chamber of the pump 1, this pumping chamber not being illustrated in detail. Through the pump plate 29 (via line 31 illustrated with a dashed line), the pumping chamber is connected with a bore 32 in the intermediate wall. The bore 32 leads vertically to the top of the wall and continues as an intake.

A seal ring 33, located at step 26, seals the pumping chamber from the outside. Between the steps 27 and 28, an oil pump is located which, in a known manner, is composed of two annular gears 34 and 35. The oil pump serves to transport oil from the pump chamber 19 to an oil filter located above the pumps. A bore 36 (with feeding line 37 illustrated as dashed line) in the intermediate wall is used to accommodate oil flow. The arrangement of gas or oil carrying bores in the intermediate walls has the advantage that the elements (intake, oil filter) communicating with the bores can be simply fastened above the pumps.

At the height of the intermediate walls, the end of the shaft 2 is surrounded by a bearing housing 41. The pump gear 3 includes a collar 42 which extends in the direction of the pump 1. This collar supports itself in the bearing housing 41 via the bearings 43 and 44. On their inside surfaces, the pump gear 3 and the collar 42 are equipped with a groove 45. A spring 46 engages the groove with the spring being connected with the end of the shaft 2. With this groove-spring arrangement, the torque is transmitted.

The pump gear 3 is floatingly secured along its axis, i.e. provided with bearing play. Towards this end, a sleeve 47 surrounding the shaft 2 is provided at the level of the pump gear 3 and the collar 42, which supports itself on the step 28 of the shaft 2 via a second sleeve 48. With the aid of the screwed connection 49 and the plate 51, the two sleeves 47 and 48 are axially secured. At its end remote from the plate 51, the sleeve 47 has a flange 52. The distance between the plate 51 and the flange 52 is selected such that axial shifting of the pump gear 3 is possible to a limited extent on the sleeve 47. This permits axially directed forces from pump gear 3 to be largely isolated from the shaft, so that the shaft is not affected by drive variations.

The described arrangement has the advantage that three different oil chambers 18, 19, 21 exist. The oil of the pump chambers 18 and 19 in which the pumps are located can be kept clean with the help of oil filters. It suffices that only two or three of the pumps 1 are equipped with oil filters. It is not necessary for the oil in the gear chamber 21, which serves for the lubrication of the gears 3, 8 to be filtered or recirculated. The is no need to change this oil after the breaking-in of the gears 3, 8.

Other objects, features and advantages of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. A multiple connection for a plurality of rotation vacuum pumps, said pumps being arranged in two rows and sharing a common drive motor, wherein said multiple connection comprises the following:

each of said vacuum pumps comprises a toothed pump gear;

said drive motor comprises a toothed drive gear; and said toothed pump gears and said toothed drive gear are arranged in a single row, and with their teeth drivingly intermeshed;

wherein said drive gear is located approximately in the center of said row;

said drive gear is connected to a shaft;

said vacuum pumps and said shaft are alternatingly arranged on opposite sides of said single row;

wherein said drive motor directly drives said shaft and is arranged, with respect to said single row, as are said vacuum pumps;

said drive motor is arranged above said vacuum pumps; and said drive motor is connected to said shaft by means of a chain and chain gear.

2. A multiple connection for a plurality of rotation vacuum pumps, said pumps being arranged in two rows and sharing a common drive motor, wherein said multiple connection comprises the following:

each of said vacuum pumps comprises a toothed pump gear;

said drive motor comprises a toothed drive gear;

said toothed pump gears and said toothed drive gear are arranged in a single row, and with their teeth drivingly intermeshed;

wherein said drive gear is located approximately in the center of said row;

said drive gear is connected to a shaft;

said vacuum pumps and said shaft are alternatingly arranged on opposite sides of said single row;

wherein said vacuum pumps are located in a common housing also containing lubricating oil;

wherein said single row is located in a separate gear chamber in said common housing;

said common housing comprises outside walls;

said separate gear chamber is formed between facing surfaces of two dividing walls;

first and second pump chambers are located on opposite sides of said separate gear chamber and formed by said dividing walls and said outside walls; and said vacuum pumps are disposed in said chamber and secured to said dividing walls;

wherein said dividing walls comprise fluid-conducting bores in communication with said vacuum pumps.

3. The multiple connection of claim 2, further wherein each of said pump gears comprises a collar supported in a bearing housing mounted in one of said dividing walls.

4. The multiple connection of claim 3, further wherein each of said pump gears is floatingly secured to a shaft of one of said vacuum pumps.

5. The multiple connection of claim 4, further wherein each of said vacuum pump shafts comprises a bushing to allow limited axial movement between the shaft and its corresponding pump gear.

* * * * *